US010865747B2

(12) United States Patent
Miura et al.

(10) Patent No.: US 10,865,747 B2
(45) Date of Patent: Dec. 15, 2020

(54) EGR MALFUNCTION DETECTION SYSTEM

(71) Applicant: SUBARU CORPORATION, Tokyo (JP)

(72) Inventors: Naoki Miura, Toyko (JP); Yoshiki Isobe, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 130 days.

(21) Appl. No.: 15/895,349

(22) Filed: Feb. 13, 2018

(65) Prior Publication Data

US 2018/0283326 A1 Oct. 4, 2018

(30) Foreign Application Priority Data

Mar. 30, 2017 (JP) ..... 2017-068765

(51) Int. Cl.
*F02M 26/49* (2016.01)
*F02M 26/52* (2016.01)
(Continued)

(52) U.S. Cl.
CPC ..... *F02M 26/49* (2016.02); *F02M 26/45* (2016.02); *F02M 26/52* (2016.02); *F02D 2200/0406* (2013.01); *F02M 26/48* (2016.02)

(58) Field of Classification Search
CPC ..... F02M 26/49; F02M 26/45; F02M 26/52; F02M 26/48; Y02T 10/121; F02D 2200/0406
(Continued)

(56) References Cited

U.S. PATENT DOCUMENTS 5,635,633 A * 6/1997 Kadota ..... F02D 41/22 123/520
6,390,077 B1 * 5/2002 Simpson ..... F02M 26/49 123/568.16
(Continued)

FOREIGN PATENT DOCUMENTS

JP 2005-282379 A 10/2005
JP 2006-177257 A 7/2006
(Continued)

OTHER PUBLICATIONS

Notification of Decision of Grant dated Aug. 21, 2018 during the prosecution of Japanese Patent Application No. 2017-058765.

*Primary Examiner* — Mahmoud Gimie
*Assistant Examiner* — Joshua Campbell
(74) *Attorney, Agent, or Firm* — Troutman Pepper Hamilton Sanders LLP

(57) ABSTRACT

An EGR malfunction detection system includes an EGR valve configured to open and close an exhaust recirculation path for recirculating an exhaust gas from an exhaust channel to an intake channel of an engine, a measurement unit configured to measure an intake pressure inside the intake channel, a valve controller configured to control the EGR valve, and a malfunction detector configured to detect an anomaly in the exhaust recirculation path in accordance with a measurement unit output and a valve controller output. The malfunction detector determines whether the EGR valve is stuck in accordance with the intake pressures measured when the EGR valve is controlled to open and close. If the EGR valve is stuck, the malfunction detector determines whether the EGR valve is stuck in an open state, stuck in a closed state, or stuck in an intermediate state by comparing the measured pressure with predetermined thresholds.

2 Claims, 3 Drawing Sheets

(51) Int. Cl.
*F02M 26/45* (2016.01)
*F02M 26/48* (2016.01)

(58) Field of Classification Search
USPC ..... 123/568.16; 73/117.3
See application file for complete search history.

(56) References Cited

U.S. PATENT DOCUMENTS

| | | | | |
|---|---|---|---|---|
| 2005/0210970 | A1 | 9/2005 | Terada | |
| 2010/0262356 | A1 | 10/2010 | Maruyama | |
| 2013/0298654 | A1* | 11/2013 | Heinkele | F02M 26/49 73/114.74 |
| 2016/0160746 | A1* | 6/2016 | Banker | G01L 27/007 60/602 |

FOREIGN PATENT DOCUMENTS

| | | | | | |
|---|---|---|---|---|---|
| JP | 2009-264146 | A | | 11/2009 | |
| JP | 2011-099385 | A | | 11/2009 | |
| JP | 2010-196684 | A | | 9/2010 | |
| JP | 2010-248923 | A | | 11/2010 | |
| JP | 2011-085050 | A | | 4/2011 | |
| JP | 2011-252399 | A | | 12/2011 | |
| JP | 2011252399 | A | * | 12/2011 | |
| JP | 2013199886 | A | * | 10/2013 | |
| JP | 2014-092066 | A | | 5/2014 | |
| JP | 2016-223384 | A | | 12/2016 | |
| WO | WO-2012157024 | A1 | * | 11/2012 | F02D 41/0077 |

* cited by examiner

EGR MALFUNCTION DETECTION SYSTEM

CROSS-REFERENCE TO RELATED APPLICATIONS

The present application claims priority from Japanese Patent Application No. 2017-068765 filed on Mar. 30, 2017, the entire contents of which are hereby incorporated by reference.

BACKGROUND

1. Technical Field

The present invention relates to an exhaust gas recirculation (EGR) malfunction detection system that detects a malfunction of an EGR valve.

2. Related Art

An internal-combustion engine usually includes an EGR apparatus that recirculates a portion of an exhaust gas from an exhaust channel to an intake channel via an exhaust recirculation path. In the EGR apparatus, when the exhaust gas passes through the exhaust recirculation path, an unburned component or the like in the exhaust gas is deposited on the internal surface of the exhaust recirculation path. As a result, a sticking malfunction is known to occur in which an EGR valve, which opens and closes the exhaust recirculation path, becomes stuck.

According to Japanese Unexamined Patent Application Publication (JP-A) No. 2006-177257, it is determined whether the EGR valve is stuck by sampling an intake pressure, which is the internal pressure in the intake channel, while the EGR valve is being driven forcefully. Then, if it is found that the EGR valve is stuck, it is determined whether the EGR valve is stuck in a closed state or in an open state by comparing a correction value for idling control (or a correction value for an air-fuel ratio control) with reference values for the closed state and for the open state.

However, in the method disclosed in JP-A No. 2006-177257, a process for determining whether the EGR valve is stuck in the closed state or in the open state involves complex procedures.

SUMMARY OF THE INVENTION

It is desirable to provide an EGR malfunction detection system that is capable of determining a sticking state of an EGR valve easily.

An aspect of the present invention provides an EGR malfunction detection system that includes an EGR valve configured to open and close an exhaust recirculation path for recirculating an exhaust gas from an exhaust channel to an intake channel of an engine, a measurement unit configured to measure an intake pressure inside the intake channel, a valve controller configured to control the EGR valve, and a malfunction detector configured to detect an anomaly in the exhaust recirculation path in accordance with an output from the measurement unit and an output from the valve controller. The malfunction detector determines that the EGR valve is stuck in an open state if the intake pressure is larger than a first threshold when the EGR valve is controlled to be in a closed state by the valve controller and if the intake pressure is larger than a second threshold that is larger than the first threshold when the EGR valve is controlled to be in the open state by the valve controller. The malfunction detector determines that the EGR valve is stuck in the closed state if the intake pressure is smaller than the first threshold when the EGR valve is controlled to be in the closed state by the valve controller and if the intake pressure is smaller than the second threshold when the EGR valve is controlled to be in the open state by the valve controller. The malfunction detector determines that the EGR valve is stuck in an intermediate state if the intake pressure is larger than the first threshold when the EGR valve is controlled to be in the closed state by the valve controller and if the intake pressure is smaller than the second threshold when the EGR valve is controlled to be in the open state by the valve controller.

DETAILED DESCRIPTION

Hereinafter, a desirable example of the present invention will be described in detail with reference to the accompanying drawings. Dimensions, materials, other specific numerical values, and the like indicated in the example are presented merely for illustrative purposes to facilitate the understanding of the invention and not intended to limit the present invention unless otherwise specified. In the specification and in the accompanying drawings, elements that have substantially the same functions and configurations are denoted by the same numerals or symbols, and duplicate description thereof will be omitted. In addition, elements not related directly to the present invention will not be depicted.

Figure 1:
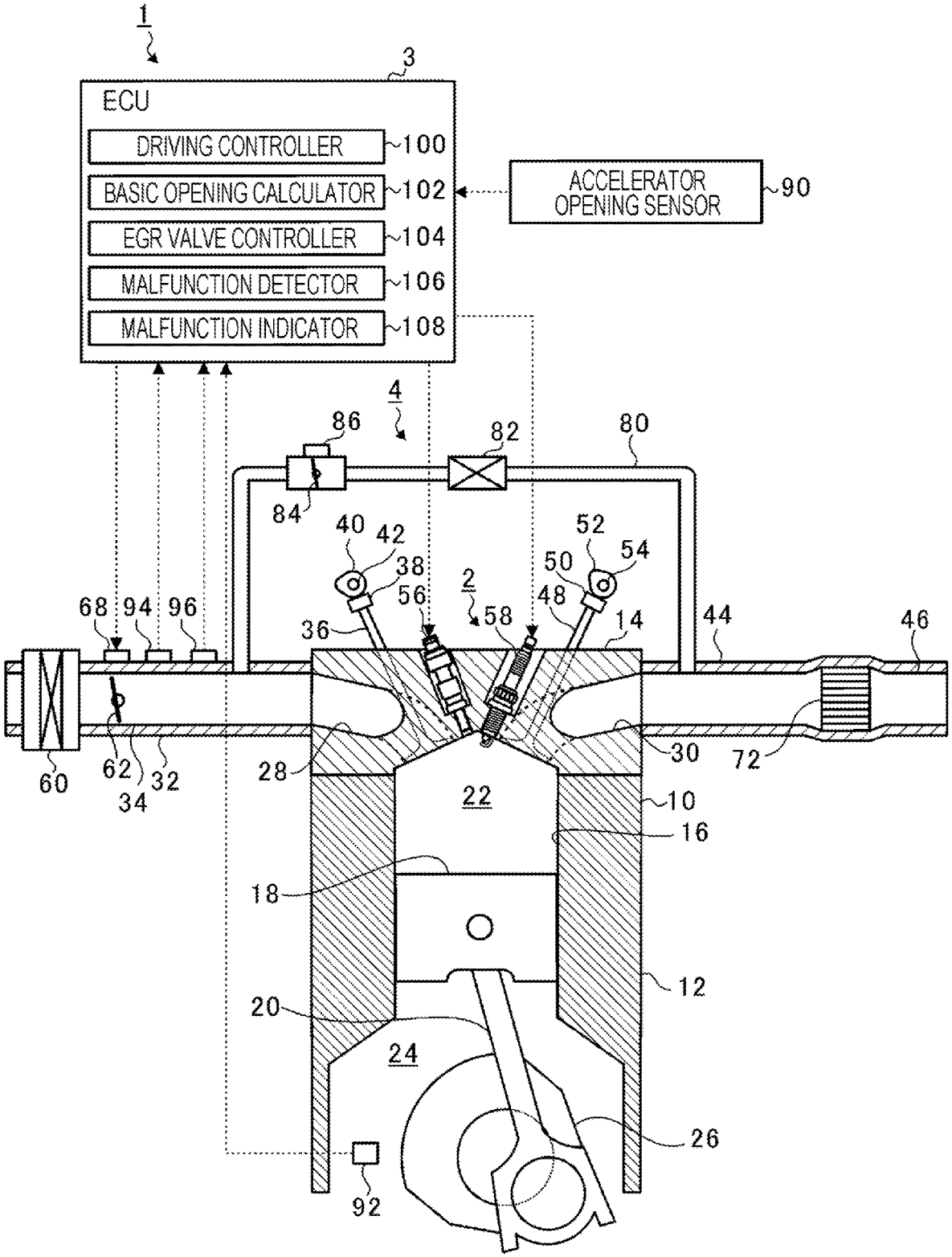
FIG. 1 schematically illustrates a configuration of an EGR malfunction detection system.

FIG. 1 schematically illustrates a configuration of an EGR malfunction detection system 1. Hereinafter, configurations and processes related to this example will be described in detail, and descriptions of configurations and processes not related to this example will be omitted.

As illustrated in FIG. 1, the EGR malfunction detection system 1 includes an engine 2 and an engine control unit (ECU) 3. The ECU 3 controls driving of the engine 2 as a whole.

The engine 2 includes a cylinder block 10, a crankcase 12 formed with the cylinder block 10 as a single body, and a cylinder head 14 coupled to the cylinder block 10.

The cylinder block 10 includes a plurality of cylinders 16, and a piston 18 is supported by a connecting rod 20 so as to be slidable inside each of the plurality of cylinders 16. A space enclosed by the cylinder head 14, each of the plurality of cylinders 16, and a crown surface of the corresponding piston 18 is formed as a combustion chamber 22.

The engine 2 includes a crank chamber 24 formed by the crankcase 12, and a crankshaft 26 is supported rotatably in the crank chamber 24. The piston 18 is coupled to the crankshaft 26 via a connecting rod 20.

The cylinder head 14 includes an intake port 28 and an exhaust port 30 that communicate with the combustion chamber 22.

An intake channel 34 including an intake manifold 32 is coupled to the intake port 28. The intake port 28 has an opening on the upstream side of an intake gas facing the intake manifold 32 and two openings on the downstream side facing the combustion chamber 22, and the flow channel through the intake port 28 branches into two channels as the intake gas flows from the upstream side to the downstream side.

The leading end of an intake valve 36 is disposed between the intake port 28 and the combustion chamber 22. The tail end of the intake valve 36 is in contact with a cam 42 that is fixed to an intake camshaft 40 via a rocker arm 38. The intake valve 36 opens and closes the intake port 28 to the combustion chamber 22 as the intake camshaft 40 rotates.

An exhaust channel 46 including an exhaust manifold 44 is coupled to the exhaust port 30. The exhaust port 30 has two openings on the upstream side of an exhaust gas facing the combustion chamber 22 and an opening on the downstream side facing the exhaust manifold 44, and the flow channels through the exhaust port 30 merge into a single channel as the exhaust gas flows from the upstream side to the downstream side.

The leading end of an exhaust valve 48 is disposed between the exhaust port 30 and the combustion chamber 22. The tail end of the exhaust valve 48 is in contact with a cam 54 that is fixed to an exhaust camshaft 52 via a rocker arm 50. The exhaust valve 48 opens and closes the exhaust port 30 to the combustion chamber 22 as the exhaust camshaft 52 rotates.

An injector 56 and an ignition plug 58 are disposed in the cylinder head 14 so that the leading ends of the injector 56 and the ignition plug 58 are located inside the combustion chamber 22. Fuel is injected from the injector 56 toward air flowing into the combustion chamber 22 via the intake port 28. Then, a mixture of air and fuel is ignited by the ignition plug 58 at a predetermined timing and combusted. Such combustion causes a reciprocating motion of the piston 18 in the cylinder 16, and the reciprocating motion is converted to rotation of the crankshaft 26 via the connecting rod 20.

The intake channel 34 is provided with an air cleaner 60 and a throttle valve 62 in this order from the upstream side. The air cleaner 60 removes foreign substances mixed in the air taken in from outside. The throttle valve 62 is driven to open and close by an actuator 68 depending on the opening or depression of an accelerator pedal (not depicted) and regulates an amount of air supplied to the combustion chamber 22.

A catalyst 72 is disposed inside the exhaust channel 46. The catalyst 72 is, for instance, a three-way-catalyst, includes platinum (Pt), palladium (Pd), and rhodium (Rh), and removes hydrocarbon (HC), carbon monoxide (CO), and nitrogen oxide (NOx) from the exhaust gas discharged from the combustion chamber 22.

The engine 2 includes an EGR apparatus 4. The EGR apparatus 4 includes an exhaust recirculation path 80. The exhaust recirculation path 80 is disposed so that the intake channel 34 and the exhaust channel 46 communicate with each other and recirculates a portion of the exhaust gas flowing through the exhaust channel 46 to the intake channel 34. The exhaust recirculation path 80 includes an EGR cooler 82 configured to reduce the exhaust gas temperature and an EGR valve 84 configured to control a flowrate of the exhaust gas flowing through the exhaust recirculation path 80. For instance, the EGR valve 84 is a butterfly valve and the opening of the EGR valve 84 is controlled by using a stepping motor 86. Hereinafter, the exhaust gas flowing through the exhaust recirculation path 80 is also called an EGR gas.

The EGR malfunction detection system 1 also includes an accelerator opening sensor 90, a crank angle sensor 92, a flowmeter 94, and an intake pressure sensor 96. In one example, the intake pressure sensor 96 may serve as a measurement unit. The accelerator opening sensor 90 detects an amount of depression of an accelerator pedal. The crank angle sensor 92 is disposed in the vicinity of the crankshaft 26 and outputs a pulse signal every time the crankshaft 26 rotates a predetermined angle. The flowmeter 94 is disposed downstream of the throttle valve 62 in the intake channel 34 and detects an amount of the intake gas that flows through the throttle valve 62 and that is supplied to the combustion chamber 22. The intake pressure sensor 96 is disposed in the intake manifold 32 disposed downstream of the throttle valve 62 in the intake channel 34 and measures a pressure (an intake pressure) inside the intake channel 34 (inside the intake manifold 32).

The ECU 3 is a microcomputer that includes a central processing unit (CPU), a read-only memory (ROM) in which a program and the like are stored, and a random access memory (RAM) and the like as a work area. The ECU 3 centrally controls the engine 2 and the EGR apparatus 4. In this example, when controlling the engine 2 and the EGR apparatus 4, the ECU 3 functions as a driving controller 100, a basic opening calculator 102, an EGR valve controller 104, a malfunction detector 106, and a malfunction indicator 108.

The driving controller 100 calculates the present rotation speed of the engine 2 in accordance with pulse signals detected by the crank angle sensor 92. Then, the driving controller 100 refers to a map that has been stored in advance and calculates target torque and a target rotation speed of the engine 2 in accordance with the calculated rotation speed of the engine 2 and an accelerator opening (an engine load) detected by the accelerator opening sensor 90.

The driving controller 100 also determines a target amount of air to be supplied to each of the plurality of cylinders 16 in accordance with the calculated target torque and the calculated target rotation speed of the engine 2 and determines a target throttle opening in accordance with the target amount of air thus determined.

Then, the driving controller 100 drives the actuator 68 and causes the actuator 68 to open the throttle valve 62 with the target throttle opening determined above.

The driving controller 100 also determines a target amount of injection, which is an amount of fuel that provides, for instance, the theoretical air-fuel ratio (X equal to one) in accordance with the target amount of air determined above and determines a target injection timing and a target injection duration of the injector 56 so that the amount of fuel equal to the target amount of injection thus determined is injected from the injector 56. Then, the driving controller 100 drives the injector 56 at the target injection timing and with the target injection duration and causes the injector 56 to inject the target amount of fuel.

The driving controller 100 also determines a target ignition timing of the ignition plug 58 in accordance with the calculated target rotation speed of the engine 2 and the pulse signals detected by the crank angle sensor 92. Then, the driving controller 100 activates the ignition plug 58 at the target ignition timing thus determined.

The basic opening calculator 102 calculates a target EGR ratio, which is a ratio of the EGR gas to the total amount of the intake gas and the EGR gas to be supplied to the combustion chamber 22, in accordance with the rotation speed and the load of the engine 2.

Then, the basic opening calculator 102 calculates a target EGR flowrate to recirculate to the intake channel 34 in accordance with the calculated target EGR ratio and the amount of the intake gas detected by the flowmeter 94. Subsequently, the basic opening calculator 102 calculates a basic EGR opening, which is an amount of opening of the EGR valve 84 that allows the EGR gas to recirculate at the target EGR flowrate into the intake channel 34.

The EGR valve controller 104 drives the stepping motor 86 and causes the stepping motor 86 to open the EGR valve 84 with the calculated basic EGR opening.

The malfunction detector 106 detects or diagnoses a malfunction of the EGR valve 84 in accordance with a pressure detected by the intake pressure sensor 96 and open and closed states of the EGR valve 84 controlled by the EGR valve controller 104. Upon detecting a malfunction as a result of a diagnosis, the malfunction detector 106 outputs a signal indicating an anomaly in the flowrate in the exhaust recirculation path 80.

If the malfunction detector 106 detects a malfunction of the EGR valve 84, the malfunction indicator 108 switches on an alarm lamp (a malfunction indication lamp) disposed on an instrument panel to notify a driver of the malfunction.

Hereinafter, a malfunction diagnosis of the EGR valve 84 (hereinafter referred to as an EGR malfunction diagnosis) in this example will be described in detail.

Figure 2:
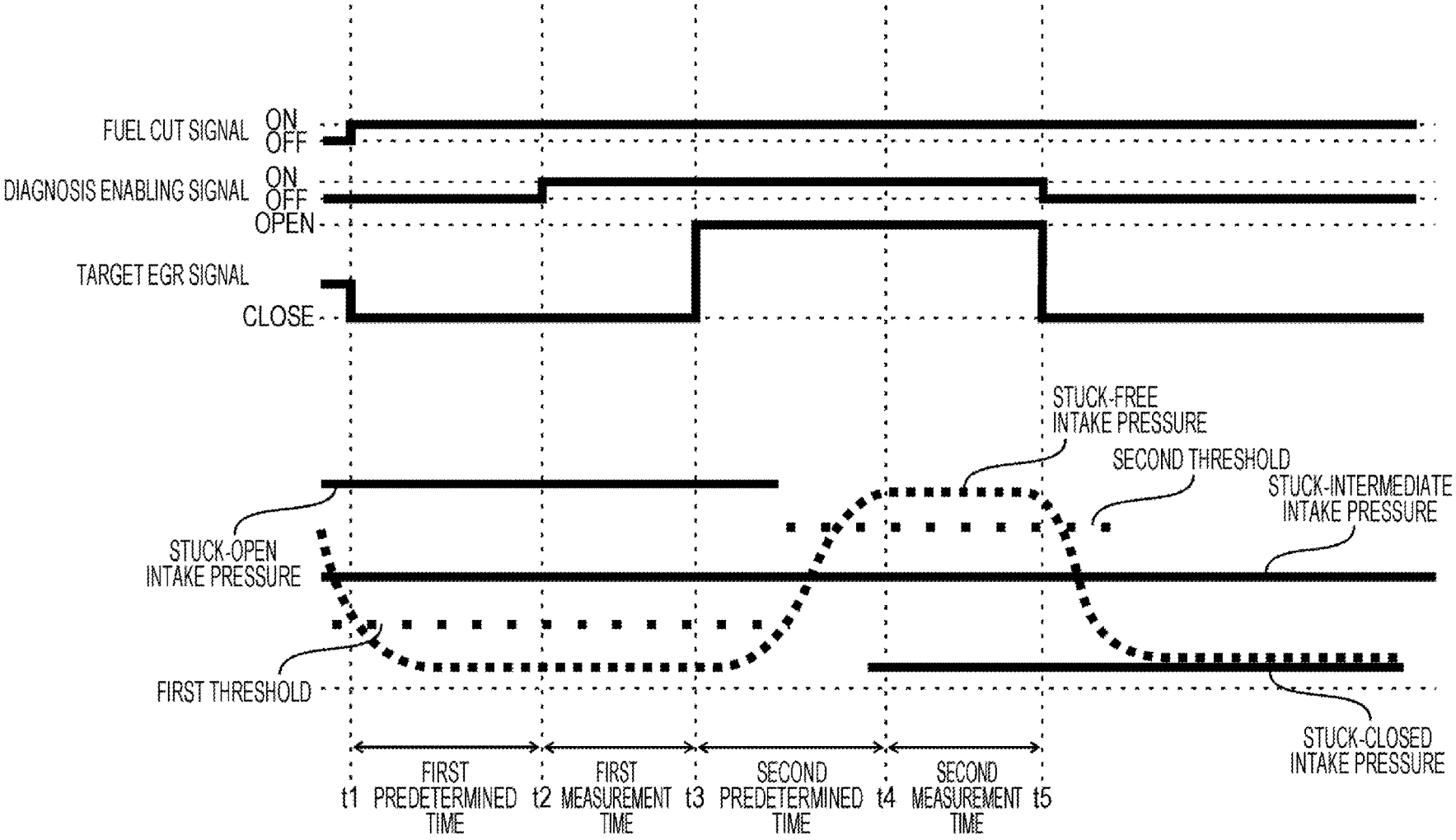
FIG. 2 is a timing chart of a malfunction detector that performs an EGR malfunction diagnosis.

FIG. 2 is a timing chart of the malfunction detector 106 that performs an EGR malfunction diagnosis.

First, the malfunction detector 106 determines whether a fuel cut signal is switched from OFF to ON.

When the fuel cut signal is switched from OFF to ON (a timing t1), the malfunction detector 106 changes a target EGR signal to CLOSE (to fully close the EGR valve 84). When the EGR valve 84 is fully closed, the EGR gas stops flowing into the intake channel 34 from the exhaust channel 46. Thus, the pressure inside the intake manifold 32 becomes negative because the piston 18 suctions the intake gas. Consequently, the intake pressure detected by the intake pressure sensor 96 decreases.

After the EGR valve 84 is fully closed at the timing t1, the malfunction detector 106 waits for a time (a first predetermined time, for instance, two to three seconds) taken for a change (a decrease) in the intake pressure detected by the intake pressure sensor 96 to stabilize.

When the first predetermined time has elapsed since the timing t1, the malfunction detector 106 changes a diagnosis enabling signal from OFF to ON and starts measuring the intake pressure at a timing t2. The malfunction detector 106 measures the intake pressure a plurality of times within a predetermined time and calculates the average of the measured values. The malfunction detector 106 terminates measuring the intake pressure when a time taken to calculate the average (a first measurement time) has elapsed. The average of the intake pressures measured within the first measurement time is called a first intake pressure.

When the first measurement time has elapsed since the timing t2, the malfunction detector 106 changes the target EGR signal to OPEN (to fully open the EGR valve 84) at a timing t3. When the EGR valve 84 is fully opened, the intake pressure increases because the EGR gas flows into the intake channel 34 from the exhaust channel 46.

After the EGR valve 84 is fully opened at the timing t3, the malfunction detector 106 waits for a time (a second predetermined time) taken for a change (an increase) in the intake pressure detected by the intake pressure sensor 96 to stabilize. The second predetermined time is set to duration shorter than the first predetermined time (for instance, 1.5 seconds) so as to reduce a time during which the EGR valve 84 is forcefully kept fully opened during a deceleration fuel cut.

When the second predetermined time has elapsed since the timing t3, the malfunction detector 106 starts measuring the intake pressure at a timing t4. The malfunction detector 106 measures the intake pressure a plurality of times within a predetermined time and calculates the average of the measured values. The malfunction detector 106 terminates measuring the intake pressure when a time taken to calculate the average (a second measurement time) has elapsed. The average of the intake pressures measured within the second measurement time is called a second intake pressure.

When the second measurement time has elapsed since the timing t4, the malfunction detector 106 changes the diagnosis enabling signal from ON to OFF and the target EGR signal to CLOSE at a timing t5.

The malfunction detector 106 compares the first intake pressure measured within the first measurement time with a first threshold and compares the second intake pressure measured within the second measurement time with a second threshold. The first threshold is equal to the sum of an intake pressure measured with the EGR valve 84 fully closed and a predetermined value (for instance, a value used to take account of variations in the intake pressure sensor 96 and variations in the throttle opening). The second threshold is equal to a value obtained by subtracting a predetermined value (for instance, a value used to take account of variations in the intake pressure sensor 96 and variations in the throttle opening) from an intake pressure measured with the EGR valve 84 fully opened. The first threshold is smaller than the second threshold.

The malfunction detector 106 compares the first intake pressure with the first threshold and compares the second intake pressure with the second threshold. Then, if the first intake pressure is smaller than the first threshold and the second intake pressure is smaller than the second threshold (a case where the intake pressure is equal to, for example, the stuck-closed intake pressure depicted in FIG. 2), the malfunction detector 106 determines that the EGR valve 84 is stuck in a closed state (a malfunction exists). In this case, whereas the first intake pressure is smaller than the first threshold when the EGR valve 84 is controlled to be in the closed state, the second intake pressure is smaller than the second threshold although the EGR valve 84 is controlled to be in an open state. In other words, the EGR gas does not flow into the intake manifold 32 despite the EGR valve 84 being controlled to be in the open state. When the EGR valve 84 is stuck in the closed state, the first intake pressure is smaller than the first threshold and the second intake pressure is smaller than the second threshold as described above. Consequently, when the first intake pressure is smaller than the first threshold and the second intake pressure is smaller than the second threshold, the malfunction detector 106 determines that the EGR valve 84 is stuck in the closed state.

On the other hand, the malfunction detector 106 determines that the EGR valve 84 is stuck to be fully open (in the open state) (a malfunction exists) if the first intake pressure is larger than the first threshold and the second intake pressure is larger than the second threshold (a case where the intake pressure is equal to, for example, the stuck-open intake pressure depicted in FIG. 2). In this case, whereas the second intake pressure is larger than the second threshold when the EGR valve 84 is controlled to be in the open state, the first intake pressure is larger than the first threshold although the EGR valve 84 is controlled to be in the closed state. In other words, the EGR gas flows into the intake manifold 32 despite the EGR valve 84 being controlled to be in the closed state. When the EGR valve 84 is stuck in the open state, the first intake pressure is larger than the first threshold and the second intake pressure is larger than the second threshold as described above. Consequently, when the first intake pressure is larger than the first threshold and the second intake pressure is larger than the second threshold, the malfunction detector 106 determines that the EGR valve 84 is stuck in the open state.

Further, the malfunction detector 106 determines that the EGR valve 84 is stuck in an intermediate state (between the open state and the closed state) (a malfunction exists) if the first intake pressure is larger than the first threshold and the second intake pressure is smaller than the second threshold (a case where the intake pressure is equal to, for example, the stuck-intermediate intake pressure depicted in FIG. 2). In this case, the first intake pressure is larger than the first threshold although the EGR valve 84 is controlled to be in the closed state, and the second intake pressure is smaller than the second threshold although the EGR valve 84 is controlled to be in the open state. In other words, the EGR gas flows into the intake manifold 32 despite the EGR valve 84 being controlled to be in the closed state. In addition, the EGR gas does not flow into the intake manifold 32 as much as when the EGR valve is actually in the open state despite the EGR valve 84 being controlled to be in the open state. When the EGR valve 84 is stuck in the intermediate state, which is neither the open state nor the closed state, the first intake pressure is larger than the first threshold and the second intake pressure is smaller than the second threshold as described above. Consequently, when the first intake pressure is larger than the first threshold and the second intake pressure is smaller than the second threshold, the malfunction detector 106 determines that the EGR valve 84 is stuck in the intermediate state.

The malfunction detector 106 determines that the EGR valve 84 is not stuck but is in a normal state (no malfunction exists) if the first intake pressure is smaller than the first threshold and the second intake pressure is larger than the second threshold (a case where the intake pressure is equal to, for example, the stuck-free intake pressure depicted in FIG. 2).

Upon detecting a malfunction as a result of determination, the malfunction detector 106 outputs a signal indicating an anomaly in the flowrate in the exhaust recirculation path 80 as described below. Specifically, when the malfunction detector 106 determines that the EGR valve 84 is stuck in the open state, the malfunction detector 106 outputs a first signal, which indicates that the EGR valve 84 is stuck in the open state. When the malfunction detector 106 determines that the EGR valve 84 is stuck in the closed state, the malfunction detector 106 outputs a second signal, which indicates that the EGR valve 84 is stuck in the closed state. When the malfunction detector 106 determines that the EGR valve 84 is stuck in the intermediate state, the malfunction detector 106 outputs both the first signal and the second signal. The signal that is output by the malfunction detector 106 and that indicates the anomaly in the flowrate is stored in the RAM (not depicted) of the ECU 3. In addition, when the malfunction detector 106 outputs the signal that indicates the anomaly in the flowrate, the malfunction indicator 108 switches on the malfunction indication lamp disposed on the instrument panel and notifies a driver of the malfunction.

Figure 3:
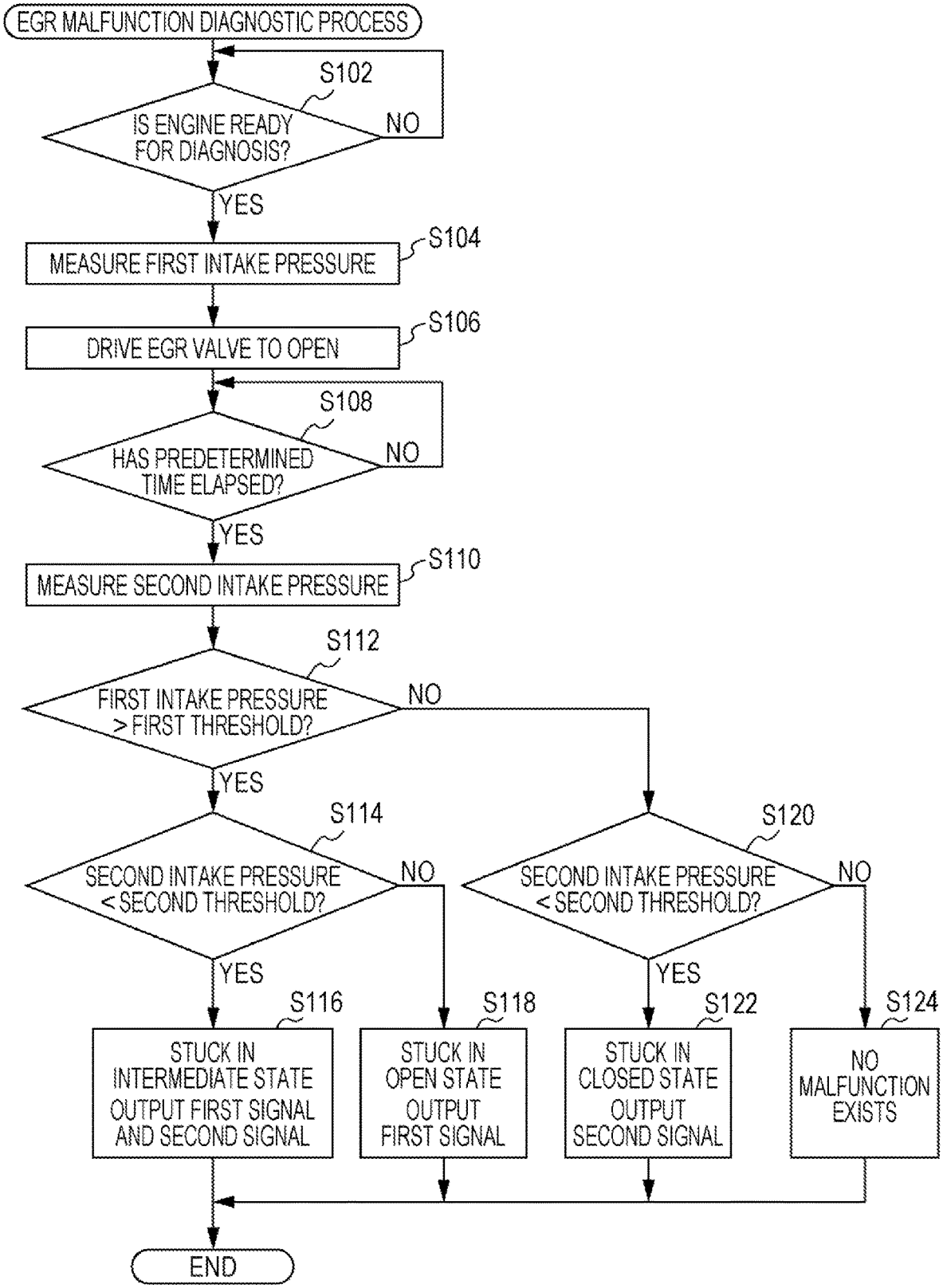
FIG. 3 is a flowchart of the malfunction detector that performs an EGR malfunction diagnosis.

FIG. 3 is a flowchart of the malfunction detector 106 that performs the EGR malfunction diagnostic process. The process depicted in FIG. 3 is performed during a deceleration fuel cut.

The malfunction detector 106 determines whether the first predetermined time described above has elapsed after the time when the engine 2 starts operating in a deceleration fuel cut state and the EGR valve 84 is controlled to be in the closed state and whether it is ready to perform the EGR malfunction diagnosis (step S102). If the predetermined time has not elapsed (NO in S102), the malfunction detector 106 repeats the processing in S102 until the predetermined time described above has elapsed. On the other hand, if the first predetermined time has elapsed (YES in S102), the malfunction detector 106 obtains the intake pressures measured by the intake pressure sensor 96 within the first measurement time described above and calculates the average (the first intake pressure) of the intake pressures (step S104).

Then, the malfunction detector 106 controls (drives) the EGR valve 84 to be in the open state so that the EGR valve fully opens (step S106).

The malfunction detector 106 determines whether the second predetermined time described above has elapsed after the malfunction detector 106 starts to control the EGR valve 84 to be in the open state (step S108). If it is determined that the second predetermined time has not elapsed (NO in S108), the processing in step S108 is repeated until the second predetermined time has elapsed. On the other hand, if it is determined that the second predetermined time has elapsed (YES in S108), the process proceeds to step S110.

The malfunction detector 106 obtains the intake pressures measured by the intake pressure sensor 96 within the second measurement time and calculates the average (the second intake pressure) of the intake pressures (step S110).

The malfunction detector 106 compares the first intake pressure calculated in step S104 with the first threshold (step S112). Then, if the first intake pressure is smaller than or equal to the first threshold (NO in S112), the process proceeds to step S120. If the first intake pressure is larger than the first threshold (YES in S112), the process proceeds to step S114.

If the first intake pressure is larger than the first threshold, the malfunction detector 106 compares the second intake pressure with the second threshold (step S114). Then, if the second intake pressure is larger than or equal to the second threshold (NO in S114), the process proceeds to step S118. If the second intake pressure is smaller than the second threshold (YES in S114), the process proceeds to step S116.

If the second intake pressure is smaller than the second threshold, the malfunction detector 106 determines that the EGR valve 84 is stuck in the intermediate state (between the open state and the closed state) because the first intake pressure is larger than the first threshold and the second intake pressure is smaller than the second threshold. Then, the malfunction detector 106 outputs the first signal and the second signal described above (that is, the signal that indicates that the EGR valve 84 is stuck in the intermediate state) (step S116) and terminates the EGR malfunction diagnostic process.

On the other hand, if the second intake pressure is larger than or equal to the second threshold in step S114, the malfunction detector 106 determines that the EGR valve 84 is stuck in the open state because the first intake pressure is larger than the first threshold and the second intake pressure is larger than or equal to the second threshold. Then, the malfunction detector 106 outputs the first signal described above (step S118) and terminates the EGR malfunction diagnostic process.

If the first intake pressure is smaller than or equal to the first threshold in step S112, the malfunction detector 106 compares the second intake pressure calculated in step S110 with the second threshold (step S120). Then, if the second intake pressure is larger than or equal to the second threshold (NO in S120), the process proceeds to step S124. If the second intake pressure is smaller than the second threshold (YES in S120), the process proceeds to step S122.

If the second intake pressure is smaller than the second threshold, the malfunction detector 106 determines that the EGR valve 84 is stuck in the closed state because the first intake pressure is smaller than or equal to the first threshold and the second intake pressure is smaller than the second threshold. Then, the malfunction detector 106 outputs the second signal described above (step S122) and terminates the EGR malfunction diagnostic process.

On the other hand, in step S120, if the second intake pressure is larger than or equal to the second threshold, the malfunction detector 106 determines that the EGR valve 84 is not stuck but is in a normal state (that is, the EGR malfunction diagnosis indicates no malfunction) because the first intake pressure is smaller than or equal to the first threshold and the second intake pressure is larger than or equal to the second threshold (step S124). Then, the malfunction detector 106 terminates the EGR malfunction diagnostic process.

Thus, the malfunction detector 106 detects a sticking state of the EGR valve 84 by determining which of the closed state, the open state, and the other state (the intermediate state) the EGR valve 84 is in and thereby avoids being incapable of detecting a sticking state (a malfunctioning state) of the EGR valve 84. The malfunction detector 106 employs simple procedures to determine in which of the closed state, the open state, and the intermediate state the EGR valve 84 is stuck only by causing the EGR valve controller 104 to forcefully drive the EGR valve 84 a single time to be in the closed state and to forcefully drive the EGR valve 84 a single time to be in the open state. Thus, according to this example, the sticking state of the EGR valve 84 is determined by employing simple procedures.

If an automobile on which the ECU 3 of this kind (the malfunction detector 106) is mounted is diagnosed for malfunctioning by connecting the automobile to an external malfunction diagnostic apparatus, a malfunction state is identified specifically and easily.

A desirable example of an aspect of the present invention has been described above with reference to the accompanying drawings. Obviously, the present invention is not limited to this example. Those skilled in the art will obviously appreciate various modifications or variations within the scope defined by the claims, and it should be construed that all such modifications and variations are within the technical scope of the invention.

The EGR malfunction detection system 1 illustrated in FIG. 1 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the EGR malfunction detection system 1 including the malfunction detector 106. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and an SRAM, and the non-volatile memory may include a ROM and an NVRAM. The ASIC is an integrated circuit (IC) customized to perform, and the FPGA is an integrated circuit designed to be configured after manufacturing in order to perform, all or a part of the functions of the modules illustrated in FIG. 1.

The invention claimed is:

1. An EGR malfunction detection system comprising:

an EGR valve configured to open and close an exhaust recirculation path for recirculating an exhaust gas from an exhaust channel to an intake channel of an engine;

a valve controller configured to control the EGR valve;

an intake pressure sensor configured to measure a first intake pressure inside the intake channel when the EGR valve is controlled to be in a closed state by the valve controller, and measure a second intake pressure inside the intake channel when the EGR valve is controlled to be in an open state by the valve controller; and a processor configured to detect an anomaly in the exhaust recirculation path in accordance with an output from the intake pressures sensor and an output from the valve controller, wherein the processor determines that the EGR valve is stuck in an open state and outputs a first signal indicating that the EGR valve is stuck in the open state, when the first intake pressure is larger than a first threshold and the second intake pressure is larger than a second threshold that is larger than the first threshold, the processor determines that the EGR valve is stuck in the closed state and outputs a second signal indicating that the EGR valve is stuck in the closed state, when the first intake pressure is smaller than the first threshold and the second intake pressure is smaller than the second threshold, and the processor determines that the EGR valve is stuck in an intermediate state and outputs both the first signal and the second signal indicating that the EGR valve is stuck in the intermediate state, when the first intake pressure is larger than the first threshold and the second intake pressure is smaller than the second threshold.

2. An EGR malfunction detection system comprising:

an EGR valve configured to open and close an exhaust recirculation path for recirculating an exhaust gas from an exhaust channel to an intake channel of an engine;

a controller configured to control the EGR valve;

a sensor configured to measure a first intake pressure inside the intake channel when the EGR valve is controlled to be in a closed state by the controller, and measure a second intake pressure inside the intake channel when the EGR valve is controlled to be in an open state by the controller; and circuitry configured to detect an anomaly in the exhaust recirculation path in accordance with an output from the sensor and an output from the controller, wherein the circuitry determines that the EGR valve is stuck in an open state and outputs a first signal indicating that the EGR valve is stuck in the open state, when the first intake pressure is larger than a first threshold and the second intake pressure is larger than a second threshold that is larger than the first threshold, the circuitry determines that the EGR valve is stuck in the closed state and outputs a second signal indicating that the EGR valve is stuck in the closed state, when the first intake pressure is smaller than the first threshold and the second intake pressure is smaller than the second threshold, and the circuitry determines that the EGR valve is stuck in an intermediate state and outputs both the first signal and the second signal indicating that the EGR valve is stuck in the intermediate state, when the first intake pressure is larger than the first threshold and the second intake pressure is smaller than the second threshold.

* * * * *